United States Patent [19]

Rabinowitz et al.

[11] 4,147,890

[45] Apr. 3, 1979

[54] HIGH VOLTAGE OVERHEAD ELECTRICAL TRANSMISSION CABLE PROTECTED FROM WET ENVIRONMENT CORONA LOSSES

[75] Inventors: Mario Rabinowitz, Menlo Park; Frank S. Young, Los Altos, both of Calif.

[73] Assignee: Electric Power Research Institute, Inc., Palo Alto, Calif.

[21] Appl. No.: 864,198

[22] Filed: Dec. 27, 1977

[51] Int. Cl.[2] ..... H01B 7/30

[52] U.S. Cl. ..... 174/127

[58] Field of Search ..... 174/127, 23 C

[56] References Cited

U.S. PATENT DOCUMENTS

| | | | |
|---|---|---|---|
| 3,286,018 | 11/1966 | McLoughlin | 174/127 |
| 3,286,019 | 11/1966 | McLoughlin | 174/127 |
| 3,286,020 | 11/1966 | McLoughlin | 174/127 |
| 3,803,339 | 4/1974 | Speekman | 174/23 C |
| 3,930,113 | 12/1975 | Johansen et al. | 174/127 |

*Primary Examiner*—Laramie E. Askin

*Attorney, Agent, or Firm*—Flehr, Hohbach, Test, Albritton & Herbert

[57] ABSTRACT

A high voltage overhead electrical transmission cable in which an electrical conductor is eccentrically disposed in a water permeable electrically conductive jacket in electrical contact with the jacket to create a chamber therebetween. A layer of high water-sorbing material, preferably water swellable and insoluble gel-forming polymer, is disposed in the chamber. In this system, water falling on the surface of the jacket permeates through it for absorption by the sorbing material to reduce corona losses.

8 Claims, 2 Drawing Figures

HIGH VOLTAGE OVERHEAD ELECTRICAL TRANSMISSION CABLE PROTECTED FROM WET ENVIRONMENT CORONA LOSSES

BACKGROUND OF THE INVENTION

The present invention relates to means for protecting high voltage overhead electrical transmission cables from wet environment corona losses.

Such cables are subject to corona losses and corona noise relating to partial electrical discharges and also decreased breakdown voltage, especially in wet environments such as during or after rainfall. Water droplets on the high voltage lines intensifies the electrical field producing corona and decreases the arc-over voltage between the lines. Thus, the distance separating three lines of a 3-phase transmission cable must be large enough to accomodate this problem during wet weather. This leads to higher costs as larger towers and additional right of ways are required.

Johansen et al. U.S. Pat. No. 3,930,113 recognizes the problem of wet weather corona losses. In the embodiment of FIG. 6 of that patent, water absorbent material such as glass fiber strands are intermingled with conductive strands and retained in place by an outer porous material, such as sintered steel. The glass fibers are stated to convey water faster in the axial direction than the radial direction for use in channelling the water along the fibers for subsequent removal, presumably at a number of water expulsion sites or spouts 5 (shown in FIG. 5). One disadvantage of this system is the requirement of such sites due to insufficient capacity in the fiber glass wicks to retain the water until the rain subsides and is permitted to evaporate away.

Another known technique for reducing corona loss is to increase the effective circumference of the power line as by contacting the conductor eccentrically with a large radius conductive material. This approach is disclosed in McLoughlin U.S. Pat. No. 3,286,020. However, there is no suggestion in that patent of any means for reducing corona problems caused by a wet environment.

SUMMARY OF THE INVENTION AND OBJECTS

In accordance with the present invention, corona losses and noise are significantly reduced in a high power overhead electrical transmission cable. An electrical conductor is disposed in a water permeable electrically conductive jacket of substantially larger radius of curvature. The conductor and jacket are in electrical contact, preferably by direct physical contact. The remaining area between the conductor and jacket is filled with a water sorbent material, preferably a water swellable and insoluble gel-forming polymer. Water falling on the surface of the permeable jacket passes through the openings and contacts the sorbent material where it is sorbed, thereby reducing corona losses and noise. Thereafter, when the wet weather terminates, the water evaporates so that the sorbent can again become fully sorbent.

It is an object of the invention to provide means for protecting the high voltage overhead electrical transmission cable from wet environment corona losses and noise.

It is a further object of the invention to so protect the cable in an inexpensive, highly effective system in which water is removed from the exterior surface of the cable structure and sorbed internally.

It is another object of the invention to provide a structure of the foregoing type which also reduces corona losses in both dry and wet weather.

Further objects and features of the invention will be apparent from the following description in which the preferred embodiments are set forth in conjunction with the appendant drawings.

DETAILED DESCRIPTION OF THE PREFERRED EMBODIMENTS

Figure 1:
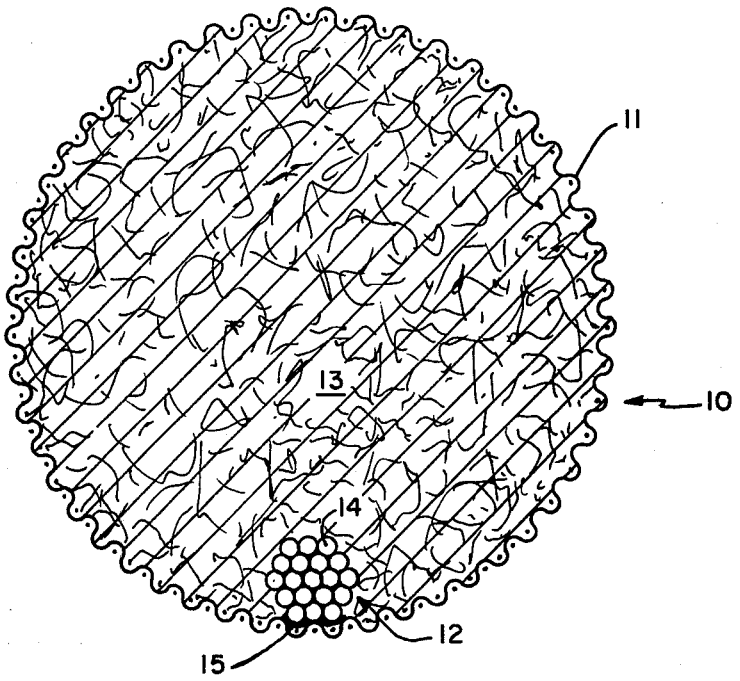
FIG. 1 is a cross-sectional view of a preferred embodiment of a high voltage overhead electrical transmission cable of the present invention.

Referring to FIG. 1, cable 10 includes a permeable jacket 11 surrounding and in contact with a stranded cable 12. The area between the jacket and cable are filled with sorbent material 13. In typical use, the illustrated cable 10 is suspended with two other spaced single-phase cables of the same type to form a 3-phase overhead cable assembly. The illustrated arrangement reduces corona losses and discharges, particularly in a wet environment as during rainfall, fog or the like. As illustrated, water droplets which fall onto the surface of jacket 11 penetrate the jacket and are absorbed by sorbent material 13. Elimination of such droplets reduces corona losses.

A preferred form of jacket 11 is an electrically conducting screen such as metal wire mesh or sintered metal screen with openings small enough to retain the sorbent material 13 in place but large enough to freely pass water droplets. In this manner, the water permeates the screen and is readily absorbed by the highly absorbent material 13 described below.

In the embodiment of FIG. 1, conductor 12 or a portion of it directly contacts jacket 11 to form an electrical contact therebetween. As illustrated, conductor 12 includes bundles of individual conductor strands 14 spiraled together. In this arrangement, an electrically conductive connection 15 such as a weld is provided between the conductor strands and jacket 11 to form an equipotential surface.

It is apparent that jacket 11 is of substantially larger radius of curvature than conductor 12, i.e., substantially in excess of twice as large. By forming the openings in the screen small enough in comparison to the wire mesh of the screen, the screen will appear electrically similar to a continuous cylinder while at the same time be open for the permeation of water from the screen surface into the sorbent material. Suitably, the thickness of the wire is equal to or slightly larger than the openings in the screen. (Similarly, for a sintered metal screen.) The larger radius of the screen surface results in a smaller electric field at its surface than would be present at the bare conductor without a screen. By connecting conductor 12 directly to the screen along its length at 15, there is no radial electrical field at the conductor, nor in the space between it and jacket 11. There is only a slight axial electric field due to the finite conductivity of the conductor. Thus, the dielectric properties of sorbent material 13 in that space, either wet or dry, would not influence the dielectric properties or the power efficiency of the cable.

As the electric field at the surface of jacket 11 is smaller than would be present at a bare conductor, any enhancement of the electric field due to protrusions, such as water droplets prior to absorption, result in a smaller electric field than if the same protrusions were present on the smaller radius conductor 12. Thus, for the short duration until the water droplets are absorbed, less corona is produced. Also, thereafter, the droplets are removed further decreasing the corona and increasing the breakdown voltage.

Referring again to FIG. 1, electrical contact with conductor 12 and jacket 11 is provided by eccentric mounting of the conductor in the jacket at the bottom of the same. This same cross-sectional configuration exists at any sectional along the axis of the cable. This arrangement simplifies construction of the cable. In addition, it permits the cable to be sleeve hoisted onto the cross-arm of a tower or pole while maintaining the integrity of the jacket, sorbent material and conductor in place so that a minimum force is exerted on the screen 11 and sorbent 13. As conductor 12 is substantially heavier than sorbent material 13, it is preferable to mount conductor 12 in the lowermost portion of the cable. However, the conductor 12 may be in any position with respect to the sorbent 13 and screen 11. The inverse position from that shown, with the conductor 12 at the top in direct electric contact with the screen 11 is the simplest from the point of view of supporting the screen and sorber.

Absorbent material 13 preferably comprises a water-swellable and insoluble gel-forming polymer capable of adsorbing at least ten times its dry weight of water. Suitable absorbent materials include cross-linked synthetic polymers. One type is manufactured by Union Carbide Corporation under the trademark "Viterra" hydrogel. This material is a nonionic polymer which is highly stable over long periods of time, even at high temperatures, and is non-biodegradable. It is stated to have a water capacity of about 20–25 times its dry weight. Another type is manufactured by Dow Chemical Corporation under the name "Gel-Guard" and "Aqua-Bibber".

A number of other solid water-insoluble sorbents that swell in water are described in a paper by Weaver et al. entitled "Highly Adsorbent Starch-Base Polymer", presented at the International Nonwovens & Disposals Association, Washington, D.C., Mar. 5–6, 1974. One such product is a base-hydrolyzed starch-polyacrylonitrile graft co-polymer in which the nitrile functionality has been converted to a mixture of carboxyamide and alkali metal carboxylate. The paper indicates that the material is capable of imbibbing about 700 times its dry weight of water.

A particular adsorbent of the general type described in the Weaver et al. paper is manufactured by General Mills Chemicals, Inc., under the designation "SGB-502S", commonly referred to as "Super Sorber".

Materials of the foregoing type are particularly suited for use in the present invention. They are highly adsorbent and so can absorb large quantities of water passing through permeable jacket 11 and thereby remove the major portion of the droplets from the surface to reduce corona losses and noise. In that regard, the material can be extruded into a shape that totally fills the eccentric chamber between jacket 11 and conductor 12 as it is readily extrudable. In this manner, the external surface of the sorbent material can directly contact the interior surface of jacket 11 and so that the sorbent material is readily accessible to the water droplets landing on the jacket surface. Other forms of such sorbent material may also be employed, if desired, such as powder or eccentrically wound tape.

The foregoing sorbent materials are relatively inexpensive. Also, they are of low density so that there is no significant increase in weight of the cable structure.

During rainfall or other wet environment conditions, water permeates the screen and penetrates the polymer network causing the size of the polymer to increase but preventing pockets of water from forming which could subsequently leak out. The water is entrapped by the molecular structure of the particles. Subsequently, when the rainfall has terminated or the fog dissipated, water can evaporate from such gel material without causing water droplets to again form on the surface of jacket 11. This differs from the Johanssen et al. patent in which water droplets can be expected to discharge from their spouts and along the cable long after the rain has ended.

Other sorbent material capable of high water absorption may also be used in accordance with the present invention. For example, although not as absorbent as the foregoing polymeric gel particles, certain molecular seive materials as of the inorganic zeolite type may be employed as the absorbent material. The theory of such molecular seives is briefly disclosed at cols. 3–5 of Rabinowitz U.S. Pat. No. 3,612,939.

A transmission line of the type illustrated in FIG. 1 is readily hoisted in a sleeve hoist arrangement for lifting to a cross-arm of a tower or pole. This method of hoisting the line ensures the integrity of the screen.

Figure 2:
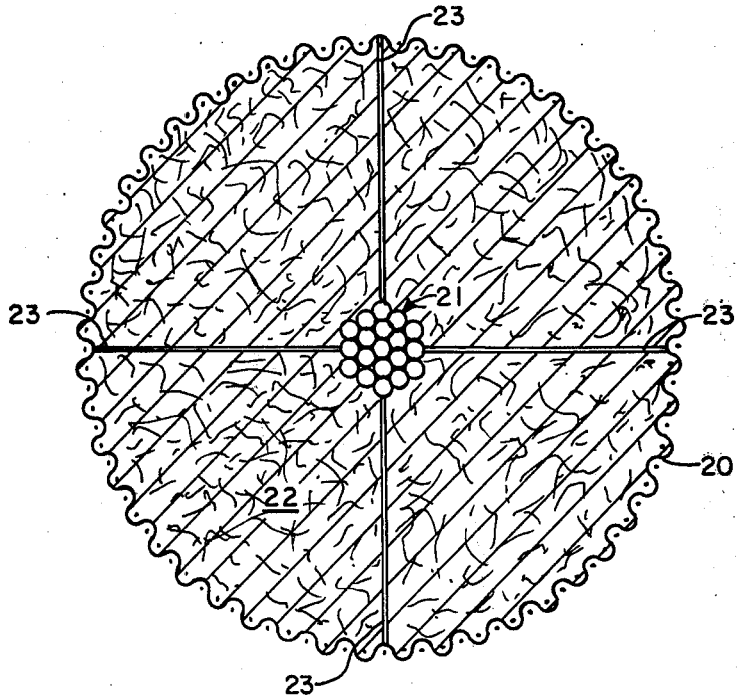
FIG. 2 is another embodiment of the cable of the present invention.

Referring to FIG. 2, another embodiment of the cable of the present invention is illustrated including a jacket 20, conductor 21, and sorbent material 22. The conductor 21 is centrally disposed and axially aligned with jacket 20. As in FIG. 1, jacket 20 is of substantially larger radius of curvature than conductor 21. It can be formed of the same electrically conductive material (e.g., a metallic screen) as jacket 11. Conductor 21 is retained in place by a series of spacers 23 at axially spaced areas of the cable sufficient to retain cable 21 in the desired position. Spacers 23 are electrically conducting. Thus, as with the embodiment of FIG. 1, the effective radius of curvature is that of jacket 20 rather than conductor 21. Similar sorbent materials 22 are employed for the embodiments of FIGS. 1 and 2.

What is claimed is:

1. A high voltage overhead electrical transmission cable protected from wet environment corona losses, comprising:

(a) an electrical conductor, (b) a water-permeable electrically conductive jacket of substantially larger radius of curvature than said electrical conductor and disposed to surround said conductor along its axis and in electrical contact therewith, at least a portion of said jacket being radially spaced from said conductor forming a chamber therebetween, and (c) a layer of water sorbent material disposed in said chamber, said sorbent material being capable of sorbing and retaining at least ten times its dry weight of water, and being selected from the group consisting of a water-swellable and insoluble gel-forming polymer and a molecular sieve material.

2. The cable of claim 1 in which said sorbent material comprises a water-swellable and insoluble gel-forming polymer.

3. The cable of claim 1 in which said jacket comprises an electrically conducting screen with openings small enough to retain said sorbent material and large enough to pass water droplets.

4. The cable of claim 3 in which said screen is formed of metal.

5. The cable of claim 1 in which said conductor is disposed eccentrically in said jacket so that part of the conductor surface directly touches the jacket in electrical contact.

6. The cable of claim 5 supported with said conductor at the bottom of the circumference of said jacket.

7. The cable of claim 1 in which said sorbent material comprises a molecular sieve material.

8. A high voltage overhead electrical transmission cable protected from wet environment corona losses comprising:

(a) an electrical conductor, (b) a water-permeable electrically conductive jacket comprising a metal screen of substantially larger radius of curvature than said electrical conductor and disposed to surround said conductor along its axis and in electrical contact therewith, at least a portion of said jacket being radially spaced from said conductor forming a chamber therebetween, said conductor being eccentrically disposed in said jacket so that part of the conductor surface directly touches the jacket, and (c) a layer of water adsorbent material disposed in said chamber, said material being selected from the group consisting of a water-swellable and insoluble gel forming polymer and a molecular sieve material.

* * * * *